US006031413A

United States Patent [19]

Mizoguchi

[11] Patent Number: 6,031,413

[45] **Date of Patent: *Feb. 29, 2000**

[54] SEMICONDUCTOR INTEGRATED CIRCUIT USING DIRECT COUPLED FET LOGIC CONFIGURATION FOR LOW POWER CONSUMPTION

[75] Inventor: Makoto Mizoguchi, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/871,100

[22] Filed: Jun. 9, 1997

[30] Foreign Application Priority Data

Nov. 25, 1996 [JP] Japan ..... 8-313510

[51] Int. Cl.[7] ..... G05F 3/16

[52] U.S. Cl. ..... 327/538; 327/530; 327/544; 327/333; 323/313

[58] Field of Search ..... 327/333, 544, 327/403, 407, 415, 530, 537; 326/117, 17; 323/313

[56] References Cited

U.S. PATENT DOCUMENTS 5,587,667 12/1996 Inami et al. ..... 326/119

*Primary Examiner*—Dinh T. Le

*Attorney, Agent, or Firm*—Armstrong, Westerman, Hattori, McLeland & Naughton

[57] ABSTRACT

A semiconductor integrated circuit is constructed with multiple stages of circuit blocks connected in vertical series between a first power supply line and a second power supply line. At least one of the circuit blocks is provided with a load unit connected in parallel therewith so that each circuit block consumes an approximately equal amount of current. This makes it possible to generate a stable intermediate voltage and suppress increases in current consumption and circuit area.

12 Claims, 6 Drawing Sheets

PARALLEL DATA INPUT
81
81
Vdd(3.3V)
SERIAL OUTPUT
88
Vce(1.65V)
7(4)
LOOP BACK STAGE (LEVEL SHIFT) (CIRCUIT)
Vss(0V)
87
87
PARALLEL OUTPUT
10
MUX
30
DEMUX
20
Vss
Vdd
Vce
Vce
6
Vdd
TX PLL
Vss
RX PLL
5
Vdd
Vss
Vce
82
CONTROL PIN
83
REFERENCE CLOCK INPUT
84
CONTROL PIN
85
CONTROL PIN
SERIAL INPUT
86

SEMICONDUCTOR INTEGRATED CIRCUIT USING DIRECT COUPLED FET LOGIC CONFIGURATION FOR LOW POWER CONSUMPTION

BACKGROUND OF THE INVENTION

1. Field of the Invention

The present invention relates to a semiconductor integrated circuit, and more particularly, to a semiconductor integrated circuit using a direct-coupled field effect transistor logic (DCFL) configuration for low power consumption.

2. Description of the Related Art

Recently, gallium arsenide semiconductor integrated circuits (GaAs ICs), because of their low power consumption and high-speed operating capability, have been finding wide practical application, with good results, in areas where a high-speed interface is required.

At the present state of the art, GaAs ICs are seldom used by themselves in systems, etc., but are usually combined with CMOS or other silicon ICs with GaAs ICs used only in areas where high-speed operation is required. In such cases, the system's supply voltage is set to match the operating voltage of the silicon IC, for example, 3.3V or 5.0V. That is, GaAs ICs, theoretically capable of operating with a supply voltage of 1V or less, have been used without making full use of their advantage of low power consumption.

In order to exploit the advantage of the low power consumption of GaAs ICs, a technique of vertical circuit stacking has been proposed in the prior art. This vertical circuit stacking technique involves using, for example, a current regulating circuit and reduces power consumption by reducing the bias applied to each circuit block to a fraction of the supply voltage, as compared to a configuration where circuit blocks are simply connected in parallel between two power supplies (a high voltage supply line and a low voltage supply line).

The prior art vertical circuit stacking technique requires inserting the current regulating circuit as an additional circuit between the high voltage and low voltage supply lines, but this has led to the problems that the power consumption of this current regulating circuit becomes large, and that the provision of the current regulating circuit increases the circuit area.

A prior art semiconductor circuit and its associated problems will be described in detail later with reference to a drawing.

SUMMARY OF THE INVENTION

It is an object of the present invention to provide a semiconductor integrated circuit configured to generate a stable intermediate voltage and prevent increases in power consumption and circuit area.

According to the present invention, there is provided a semiconductor integrated circuit having multiple stages of circuit blocks connected in vertical series between a first power supply line and a second power supply line, wherein at least one of the circuit blocks is provided with a load unit connected in parallel therewith so that each of the circuit blocks consumes an approximately equal amount of power.

The load unit may be provided for each of the circuit blocks except a circuit block having the largest power consumption value. The load unit may be constructed from a transistor or an inverter. Each of the circuit blocks may be constructed from a direct coupled field effect transistor logic circuit.

Further, according to the present invention, there is also provided a semiconductor integrated circuit having two stages of circuit blocks connected in vertical series within one chip between a first power supply line and a second power supply line, wherein of the circuit blocks, a first circuit block smaller in power consumption is provided with a load unit connected in parallel therewith so that the first circuit block draws a current equal in amount to a current that flows through a second circuit block larger in power consumption.

The load unit may be constructed from a transistor or an inverter. The first and second circuit blocks may be each constructed from a direct coupled field effect transistor logic circuit. The semiconductor integrated circuit may be a fiber channel integrated circuit, the first circuit block may include a multiplexing circuit for multiplexing low-speed parallel data and outputting high-speed serial data, and the second circuit block may include a demultiplexing circuit for demultiplexing high-speed serial data and outputting low-speed parallel data.

The first power supply line may be a high voltage supply line, the second power supply line may be a low voltage supply line, the multiplexing circuit may be driven by a high supply voltage and an intermediate supply voltage intermediate between the high supply voltage and a low supply voltage, and the demultiplexing circuit may be driven by the intermediate supply voltage and the low supply voltage. An input buffer circuit for amplifying parallel input data to be supplied to the multiplexing circuit may be configured so as to cause a full swing between a first supply voltage on the first power supply line and a second supply voltage on the second power supply line in a stage in front of a stage where level shifting to a signal level suited to the multiplexing circuit is performed.

The semiconductor integrated circuit may further comprise a transmit clock generating circuit for supplying an internal clock to the multiplexing circuit, and a receive clock generating circuit for supplying an internal clock to the demultiplexing circuit. The semiconductor integrated circuit may further comprise a loopback stage for shifting a level of an output signal of the multiplexing circuit, and for supplying the level-shifted signal to the receive clock generating circuit. The loopback stage may output complementary signals by using a differential circuit.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

Before proceeding to a description of the preferred embodiments of the semiconductor integrated circuit according to the present invention, a prior art semiconductor integrated circuit and its associated problems will be described with reference to FIG. 1.

Figure 1:
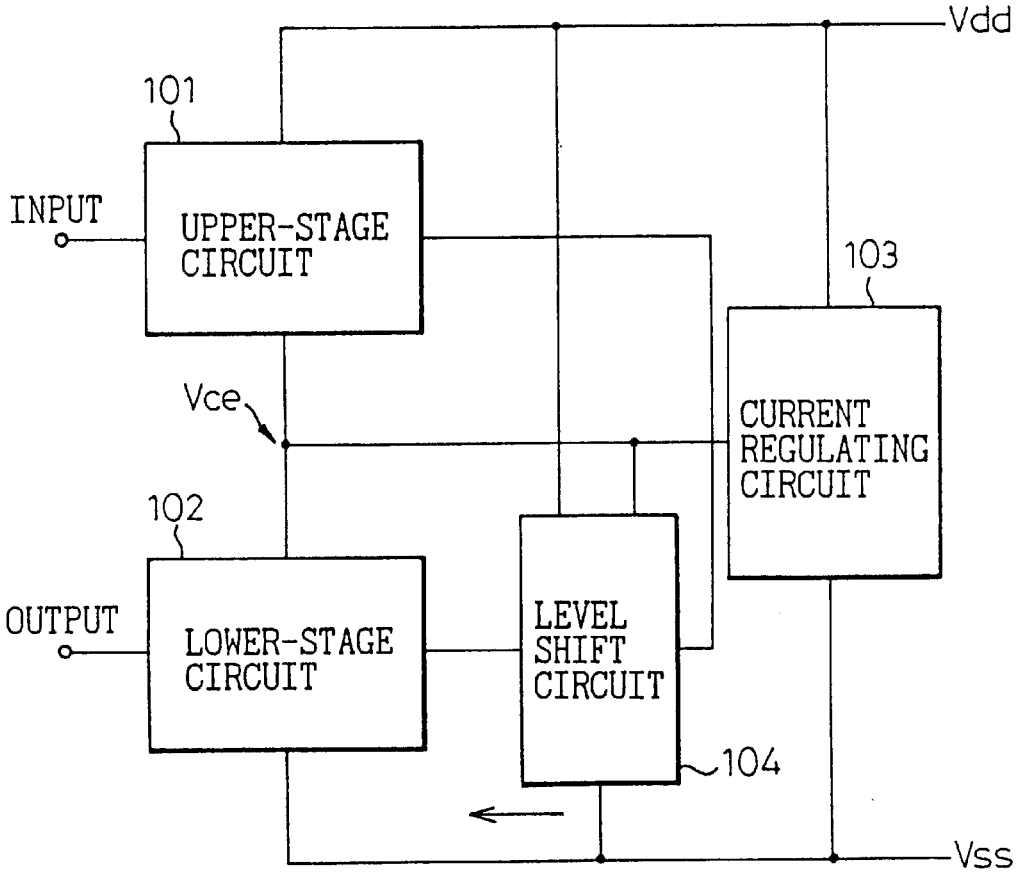
Fig.1 PRIOR ART
FIG. 1 is a block diagram showing one example of a prior art semiconductor integrated circuit.

FIG. 1 is a block diagram showing one example of the prior art semiconductor integrated circuit for which the earlier described vertical circuit stacking technique is applied. In FIG. 1, reference sign Vdd is a high voltage supply line (for example, 3.3 volts), Vss is a low voltage supply line (for example, 0 volt), Vce is an intermediate voltage supply line for supplying an intermediate voltage (for example, 1.65 volts), 101 is an upper-stage circuit, 102 is a lower-stage circuit, 103 is a current regulating circuit, and 104 is a level shift circuit. The level shift circuit 104 is a circuit, for example, for shifting signal levels so that an output signal from the upper-stage circuit 101 matches an input signal to the lower-stage circuit 102.

As shown in FIG. 1, two stages of circuit blocks, i.e., the upper-stage circuit 101 and the lower-stage circuit 102, are connected in vertical series between the high voltage supply line Vdd and the low voltage supply line Vss. Further, the current regulating circuit 103 is provided between the high voltage supply line Vdd and the low voltage supply line Vss in order to stabilize the intermediate voltage (Vce) between the upper and lower stages.

More specifically, the semiconductor integrated circuit shown in FIG. 1 uses the current regulating circuit 103 and reduces power consumption by reducing the bias applied to each circuit block to a fraction of the supply voltage, as compared to a configuration where the circuit blocks (the upper-stage circuit 101 and the lower-stage circuit 102) are simply connected in parallel between the two power supplies (the high voltage supply line Vdd and the low voltage supply line Vss).

Thus, the prior art semiconductor integrated circuit shown in FIG. 1 has required inserting the current regulating circuit 103 as an additional circuit between the high voltage supply line Vdd and the low voltage supply line Vss. This arrangement has been made in order to absorb the difference in power consumption between the upper-stage circuit 101 and the lower-stage circuit 102 and to maintain the intermediate voltage at (Vdd−Vss)/2 (=1.65 volts).

Accordingly, the semiconductor integrated circuit of FIG. 1 has had the problems to be overcome that the power consumption of the current regulating circuit 103 becomes large, and that the provision of the current regulating circuit 103 increases the circuit area.

Embodiments of the semiconductor integrated circuit according to the present invention will now be described below with reference to the accompanying drawings.

Figure 2:
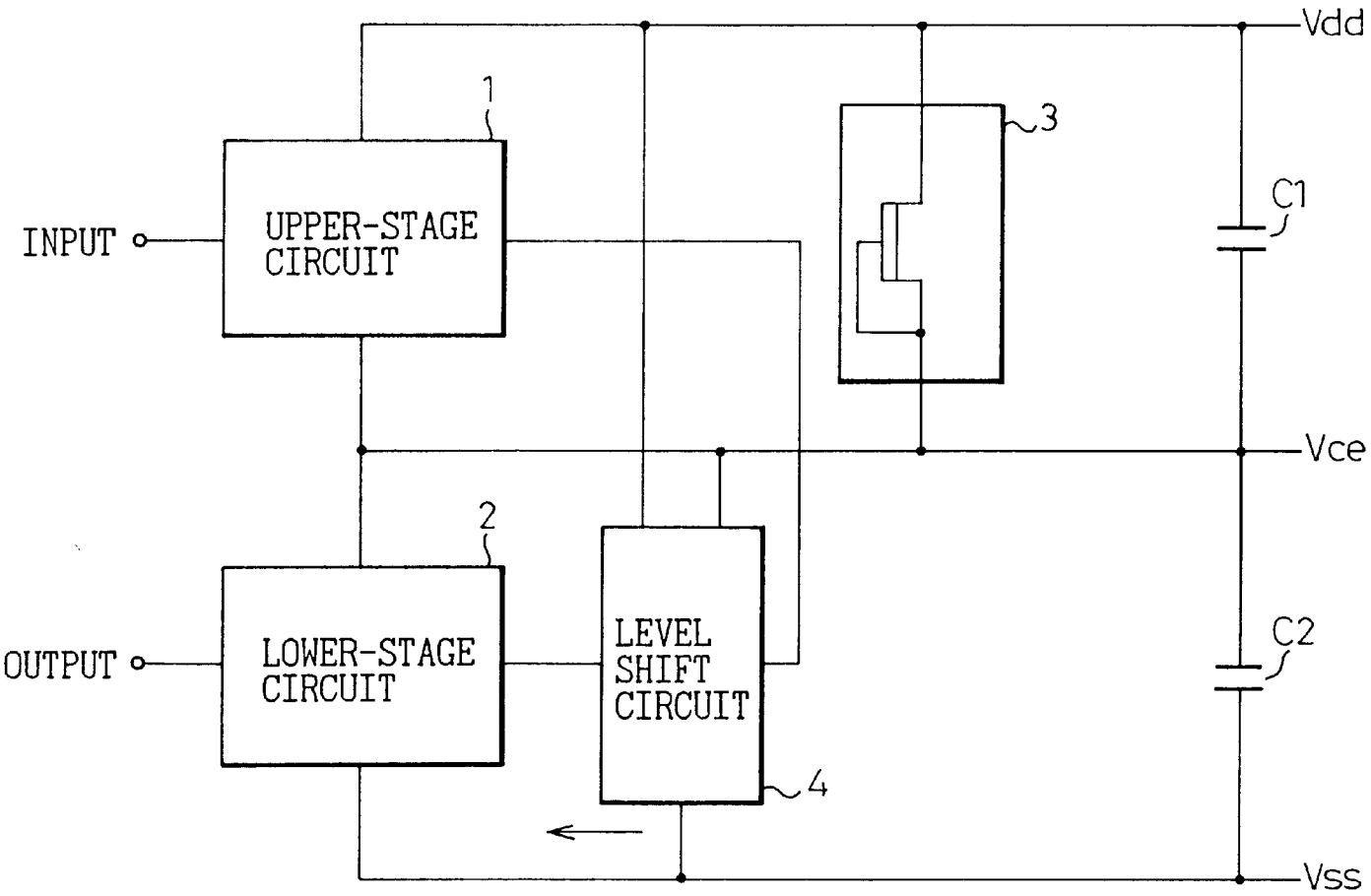
FIG. 2 is a block diagram showing the basic configuration of a semiconductor integrated circuit according to the present invention.

FIG. 2 is a block diagram showing the basic configuration of the semiconductor integrated circuit according to the present invention. In FIG. 2, reference sign Vdd is a high voltage supply line (for example, 3.3 volts), Vss is a low voltage supply line (for example, 0 volt), Vce is an intermediate voltage supply line for supplying an intermediate voltage (for example, 1.65 volts), 1 is an upper-stage circuit, 2 is a lower-stage circuit, 3 is a load transistor (load means), 4 is a level shift circuit, and C1 and C2 are smoothing capacitors. The level shift circuit 4 is a circuit, for example, for shifting a signal level so that an output signal from the upper-stage circuit 1 matches an input signal to the lower-stage circuit 2. The capacitors C1 and C2 are provided for smoothing the voltage between the high voltage supply line Vdd and the intermediate voltage supply line Vce and the voltage between the intermediate voltage supply line Vce and the low voltage supply line Vss, respectively.

As shown in FIG. 2, two stages of circuit blocks, i.e., the upper-stage circuit 1 and the lower-stage circuit 2, are connected in vertical series between the high voltage supply line Vdd and the low voltage supply line Vss. Further, the load transistor 3 is provided between the high voltage supply line Vdd and the intermediate voltage supply line Vce. The load transistor 3 is a depletion-mode MESFET, whose gate and drain are connected together to form a current source. Of the two circuits 1 and 2, the lower-stage circuit 2 the larger amount of power; hence, the load transistor (current source) 3 is connected in parallel with the upper-stage circuit 1 so that the total value of the current flowing through the upper-stage circuit 1 and the load transistor 3 becomes approximately equal to the value of the current flowing through the lower-stage circuit 2. The voltage of the intermediate voltage supply line Vce, which forms the node connecting between the upper-stage and lower-stage circuits 1 and 2, stabilizes at (Vdd+Vss)/2.

Depending on which circuit consumes the larger amount of power, the position of the load transistor 3 may be opposite to that shown in the diagram. That is, if the power consumption of the upper-stage circuit 2 is greater than that of the lower-stage circuit 1, then the load transistor 3 is connected in parallel with the lower-stage circuit 1.

Generally, the value of power consumption of a circuit is a function of the level of gate integration, the power consumption increasing or decreasing in direct proportional relationship to the scale of integration. However, the circuit with the smaller integration scale could consume the larger amount of power depending on resistors or other load devices contained therein. Therefore, to determine with which circuit, the upper-stage circuit 1 or with the lower-stage circuit 2, the load transistor 3 should be connected in parallel, the upper-stage circuit 1 and the lower-stage circuit 2 should be compared in terms of power consumption.

As described above, in the semiconductor integrated circuit of the present embodiment, since the bias applied to the load transistor 3 is reduced to (Vdd−Vss)/2, power consumption does not increase unnecessarily as in the semiconductor integrated circuit previously shown in FIG. 1. Furthermore, since the purpose of the load transistor 3 is to compensate for the difference in power consumption between the upper-stage and lower-stage stage circuits 1 and 2 within the upper-stage section (or the lower-stage section), the load transistor 3 need only be inserted between the designated biases (Vdd and Vce or Vce and Vss); in practice, the load transistor 3 can be placed anywhere on the chip, and can actually be arranged in distributed manner in available areas of the circuit, thus in effect avoiding an increase in chip area.

Figure 3:
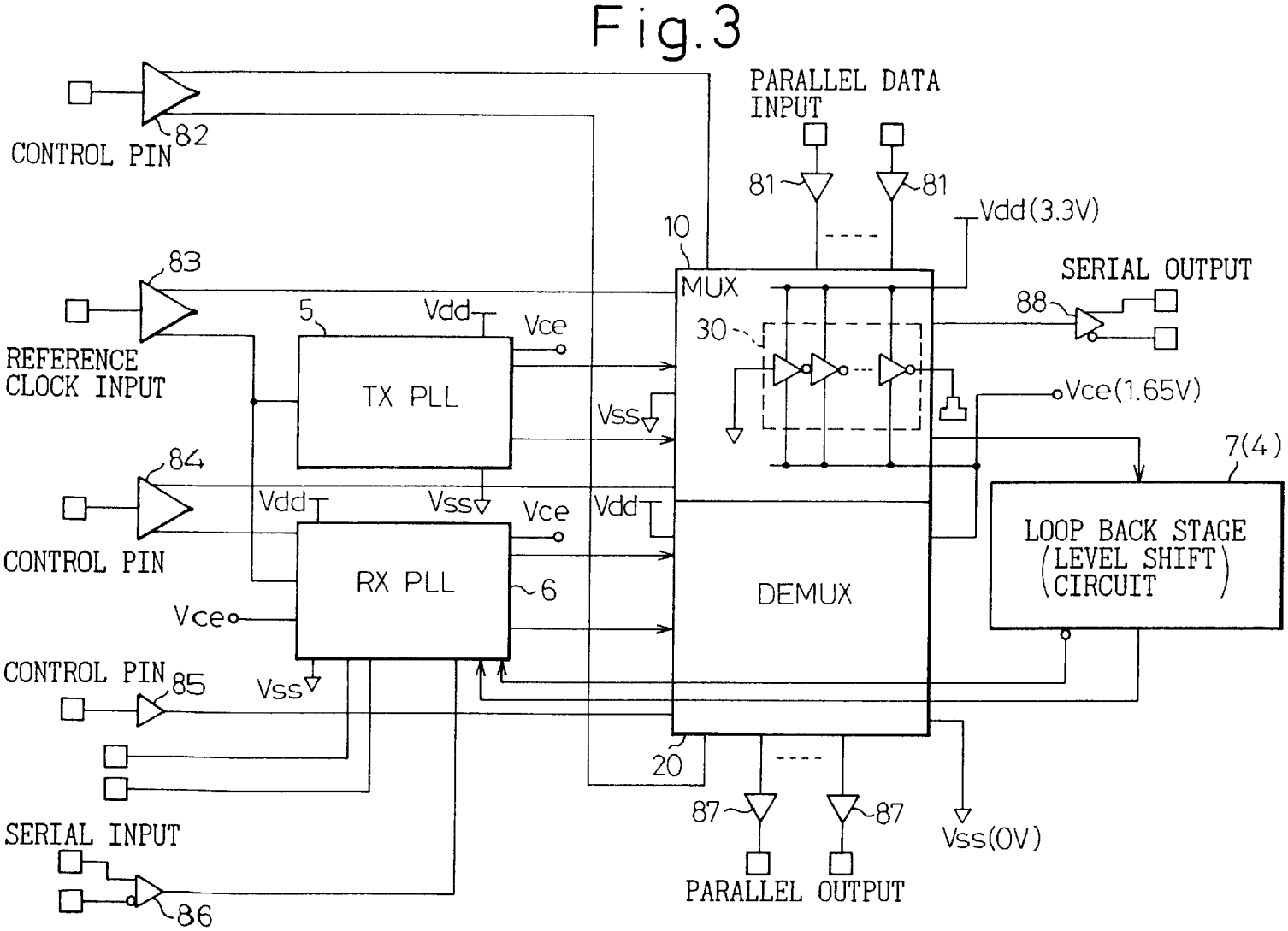
FIG. 3 is a block circuit diagram showing one embodiment of the semiconductor integrated circuit according to the present invention.

FIG. 3 is a block circuit diagram showing one embodiment of the semiconductor integrated circuit according to the present invention. Shown is a schematic diagram of a fiber channel IC (MUX/DEMUX circuit with built-in PLL). In the figure, reference numeral 10 is a multiplexing circuit (MUX), 20 is a demultiplexing circuit (DEMUX), 5 is a transmit clock generating circuit (TX PLL), 6 is a receive clock generating circuit (RX PLL), and 7 is a loopback stage (level shift circuit 4). Reference numerals 81 to 87 indicate buffer circuits for various signals.

As shown in FIG. 3, the fiber channel IC (an integrated circuit for a fiber channel transceiver) comprises the multiplexing circuit 10, demultiplexing circuit 20, transmit clock generating circuit 5, receive clock generating circuit 6, and loopback stage 7. The multiplexing circuit 10 multiplexes low-speed parallel data and outputs high-speed serial data, and the demultiplexing circuit 20 demultiplexes high-speed serial data and outputs low-speed parallel data.

More specifically, low-speed parallel data (for example, 10-bit data at 100 Mb/s) are input to the multiplexing circuit 10 via the input buffer circuits 81, and high-speed serial data (for example, serial data at 1 Gb/s) are output from the multiplexing circuit 10 via an output buffer circuit 88. The output buffer circuit 88 is configured to output complementary signals.

The multiplexing circuit 10 is also supplied with various kinds of control signals via the input buffer circuits 82 to 84 and a reference clock via the clock buffer circuit 83. Furthermore, the multiplexing circuit 10 is supplied with an output signal (phase-locked internal clock) of the transmit clock generating circuit to which the reference clock is supplied.

The demultiplexing circuit 20 is supplied with an output signal (phase-locked internal clock) of the receive clock generating circuit 6, and outputs low-speed parallel data (for example, 10-bit data at 100 Mb/s) via the output buffer circuits 87. The demultiplexing circuit 20 is also supplied with various kinds of control signals via the input buffer circuits 82, 84, and 85.

The receive clock generating circuit 6 is supplied with a signal output from the multiplexing circuit 10 and level-shifted by the loopback stage 7, as well as high-speed serial data (for example, data at 1 Gb/s) input via the input buffer circuit 86. Furthermore, the receive clock generating circuit 6 is supplied with the reference clock via the clock buffer circuit 83 and the control signal via the input buffer circuit 84. The input buffer circuit 86 is configured to generate a serial input signal from complementary signals.

The high voltage supply line (Vdd: for example, 3.3 volts) and intermediate voltage supply line (Vce: for example, 1.65 volts) for driving the multiplexing circuit 10 are connected to the multiplexing circuit 10. In the multiplexing circuit 10, a plurality of inverters (load means) 30 are connected between the high voltage supply line Vdd and intermediate voltage supply line Vce so that a prescribed current flows. On the other hand, the demultiplexer 20 is connected to the intermediate voltage supply line Vce and low voltage supply line (Vss: for example, 0 volt). Further, the transmit clock generating circuit 5 and receive clock generating circuit 6 are connected to the high voltage supply line Vdd, intermediate voltage supply line Vce, and low voltage supply line Vss. Parts (I/O) operating on 3.3 to 1.65 volts in the transmit clock generating circuit 5 are connected between the high voltage supply line Vdd and the intermediate voltage supply line Vce, while parts (I/O) operating on 1.65 to 0 volts in the receive clock generating circuit 6 are connected between the intermediate voltage supply line Vce and the low voltage supply line Vss.

In the multiplexing circuit 10, the value of current Iinv, which flows between the high voltage supply line Vdd and the intermediate voltage supply line Vce through the plurality of inverters, is chosen so that the sum of the current Iinv through the inverters and the current Iup flowing through the 3.3 to 1.65-volt operating parts in the multiplexing circuit 10 and transmit clock generating circuit 5 becomes approximately equal to the current Idn flowing through the 1.65 to 0-volt operating parts in the demultiplexing circuit 20 and receive clock generating circuit 6 (that is, Iinv+Iup≈Idn). In other words, the number of inverters 30 (or the number of transistors constituting the inverters) is chosen so that the current flowing between the high voltage supply line Vdd and the intermediate voltage supply line Vce becomes approximately equal to the current flowing between the intermediate voltage supply line Vce and the low voltage supply line Vss.

The above example has shown a configuration for the case where the current Iup flowing through the 3.3 to 1.65-volt operating parts in the multiplexing circuit 10 and transmit clock generating circuit 5 (upper-stage circuit 1) is less than the current Idn flowing through the 1.65 to 0-volt operating parts in the demultiplexing circuit 20 and receive clock generating circuit 6 (lower-stage circuit 2) (that is, Iup<Idn). In the opposite case (Iup>Idn), the inverters 30 will be provided between the intermediate voltage supply line Vce and low voltage supply line Vss in the demultiplexing circuit 20. Here, the load means 3 are not limited to the inverters 30 or load transistors (3), but for example, at least one logic cell or other various load devices can also be used.

The semiconductor integrated circuit shown in FIG. 3 is configured so that not only the upper-stage circuit 1 (the multiplexing circuit 10 and transmit clock generating circuit 5) and the lower-stage circuit 2 (the demultiplexing circuit 20 and receive clock generating circuit 6) operate independently of each other, but also the signal parallel-to-serial converted by the multiplexing circuit 10 is looped back; several kinds of control signals for controlling these functions are supplied to the upper-stage and lower-stage circuits 1 and 2. Since some of the control signals, with the same logic, are supplied simultaneously to both the multiplexing circuit 10 and the demultiplexing circuit 20, actually three power supplies (3.3 V, 1.65 V, and 0 V) are used.

Figure 4:
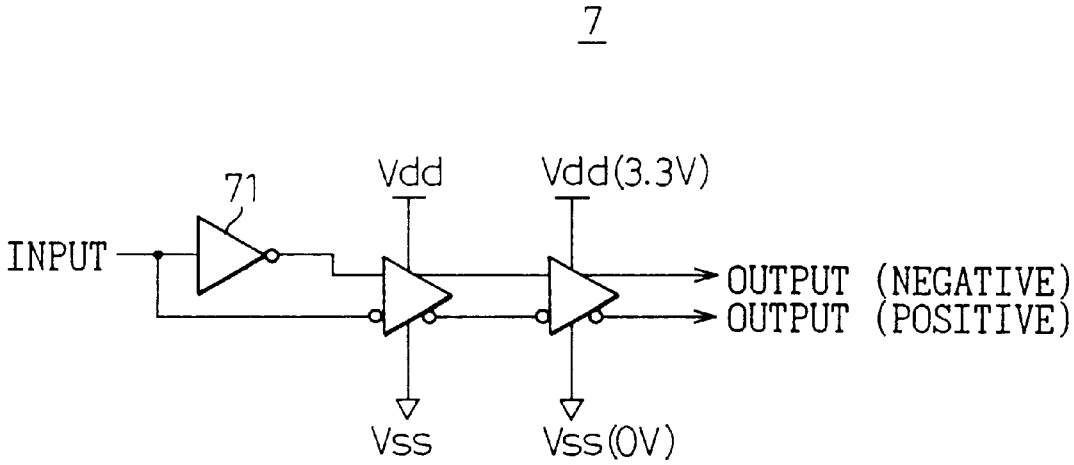
FIG. 4 is a circuit diagram showing one configurational example of a loopback stage in the semiconductor integrated circuit of FIG. 3.

FIG. 4 is a circuit diagram showing one configurational example of the loopback stage 7 (level shift circuit 4) used in the semiconductor integrated circuit of FIG. 3. The loopback stage 7 loops back the signal by shifting its level from the 3.3 to 1.65-volt level to the 1.65 to 0-volt level.

As shown in FIG. 4, the loopback stage 7 comprises an inverter 71 for generating a complementary signal from the input signal, and two stages of amplifying circuits 72 and 73 for amplifying the input signal and the complementary signal output from the inverter 71; the loopback stage 7 is thus configured as a differential circuit with high input sensitivity. The effect of constructing the loopback stage 7 from a high-sensitivity differential circuit, as shown in FIG. 4, is that when transmitting a small-swing high-speed signal, the signal can be transmitted stably to the demultiplexing circuit 20 even if node voltage of Vce targeted at 1.65 V is shifted toward the high voltage side, resulting in narrower input swing to the loopback stage 7 (level shift circuit). Here, the demultiplexing circuit 20, which receives the signal from the loopback stage 7, also performs conversion from single phase to dual phase (complementary signals) in its input stage, to ensure stable transmission of small-swing high-speed signals.

Figure 5:
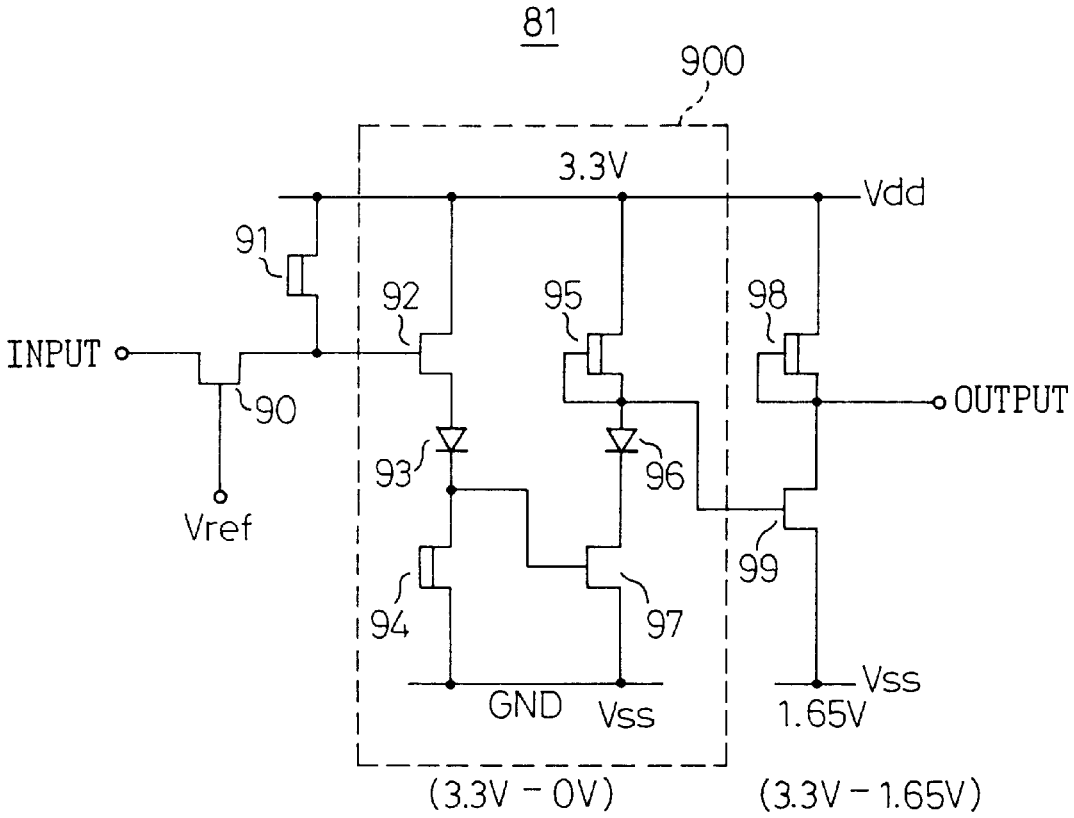
FIG. 5 is a circuit diagram showing one configurational example of an input buffer circuit in the semiconductor integrated circuit of FIG. 3.

FIG. 5 is a circuit diagram showing one configurational example of the input buffer circuit 81 used in the semiconductor integrated circuit of FIG. 3.

As shown in FIG. 5, the input buffer circuit 81 for accepting a parallel data signal for input to the multiplexing circuit 10 comprises enhancement-mode transistors (GaAs MESFETs) 90, 92, 97, and 99, depletion-mode transistors (GaAs MESFETs) 91, 94, 95, and 98, and diodes 93 and 96. The input buffer circuit 81 is configured to cause the signal to swing fully between 3.3 V and 0 V in a stage (indicated at 900 in FIG. 5) in front of a stage where the 3.3-to-1.65-volt conversion is performed by the transistors 98 and 99.

That is, by configuring the input buffer circuit 81 so as to cause the signal to swing fully between 3.3 V and 0 V in the stage (900) in front of the 3.3-to-1.65-volt conversion stage, as shown in FIG. 5, level conversion of the low-speed parallel signal can be performed stably even when the intermediate voltage (Vce) deviates somewhat from 1.65 volts (3.3/2 volts).

In the above-described embodiment, the multiplexing circuit 10 is disposed in the upper-stage section, and the demultiplexing circuit 20 in the lower-stage section, in view of the fact that the output level of a DCFL circuit is determined from the low supply voltage. That is, in a DCFL circuit using GaAs MESFETs, the low output level "L" is approximately equal to the low supply voltage, while the high level "H" is higher than the voltage of the low level "L" by about 0.6 V (gate-to-source bias voltage of GaAs MESFET); therefore, when the demultiplexing circuit 20 having the larger number of output pins is disposed in the lower-stage section, these output pins involve level shifting from the 1.65 to 0-volt level to the 3.3 to 0-volt level, which makes it possible to use the same low voltage power supply (Vss: GND) before and after the level shifting. This obviates the provision of a differential circuit in this section, preventing the number of gates from increasing. The above embodiment has been described dealing primarily with a fiber channel IC (MUX/DEMUX circuit with built-in PLL) as an example, but it will be appreciated that the semiconductor integrated circuit of the invention can be applied not only to fiber channel ICs but also to various other circuits.

Figure 6:
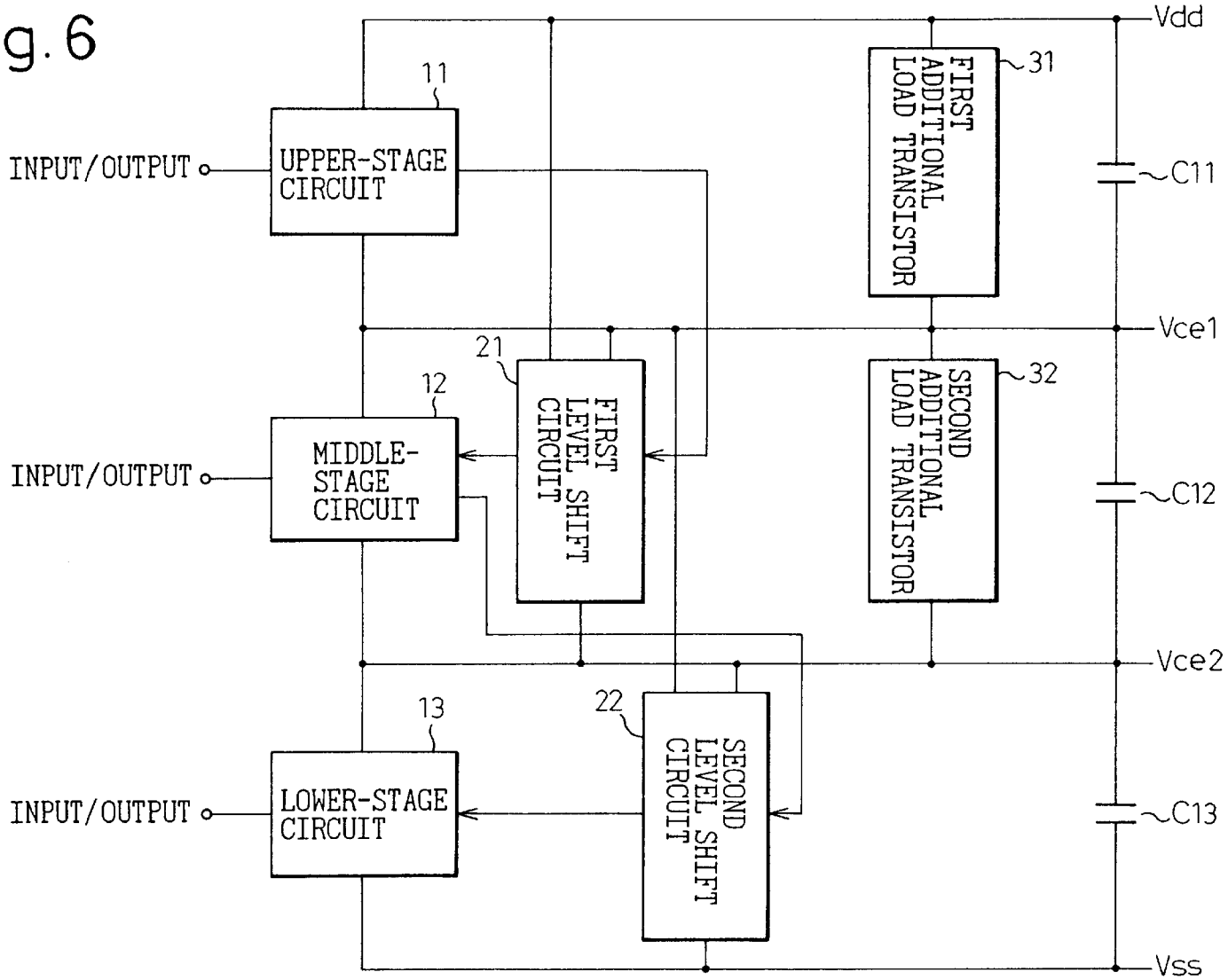
FIG. 6 is a block diagram showing in schematic form an alternative configuration of the semiconductor integrated circuit according to the present invention.

FIG. 6 is a block diagram showing an alternative configuration of the semiconductor integrated circuit of the present invention. In FIG. 6, reference numeral 11 is an upper-stage circuit, 12 is a middle-stage circuit, 13 is a lower-stage circuit, 21 is a first level shift circuit, and 22 is a second level shift circuit. Further, reference numeral 31 is a first load transistor, 32 is a second load transistor, and C11 to C13 are smoothing capacitors. Reference sign Vdd is a high voltage supply line (for example, 3.3 volts), Vss is a low voltage supply line (for example, 0 volt), Vce1 is a power supply line for supplying a first intermediate voltage (for example, 2.2 volts), and Vce2 is a power supply line for supplying a second intermediate voltage (for example, 1.1 volts).

Here, the first level shift circuit 21 is a circuit, for example, for shifting signal level so that an output signal from the upper-stage circuit 11 matches an input signal to the middle-stage circuit 12, and the second level shift circuit 22 is a circuit, for example, for shifting signal level so that an output signal from the middle-stage circuit 12 matches an input signal to the lower-stage circuit 13. The capacitors C11, C12, and C13 are capacitors for smoothing the voltage between the high voltage supply line Vdd and the first intermediate voltage supply line Vce1, the voltage between the first intermediate voltage supply line Vce1 and the second intermediate voltage supply line Vce2, and the voltage between the second intermediate voltage supply line Vce2 and the low voltage supply line Vss, respectively.

As shown in FIG. 6, three stages of circuit blocks, i.e., the upper-stage circuit 11, the middle-stage circuit 12, and the lower-stage circuit 13, are connected in vertical series between the high voltage supply line Vdd and the low voltage supply line Vss. The first load transistor 31 is provided between the high voltage supply line Vdd and the first intermediate voltage supply line Vce1, while the second load transistor 32 is provided between the first intermediate voltage supply line Vce1 and the second intermediate voltage supply line Vce2. These load transistors 31 and 32 are each constructed from a depletion-mode MESFET whose gate and drain are connected together to form a current source. Of the upper-, middle-, and lower-stage circuits, the lower-stage circuit 13 consumes the largest amount of power; therefore, the first load transistor (current source) 31 is connected in parallel with the upper-stage circuit 11 so that the total value of the current flowing through the upper-stage circuit 11 and the first load transistor 31 becomes equal to the value of the current flowing through the lower-stage circuit 13, and the second load transistor 32 is connected in parallel with the middle-stage circuit 12 so that the total value of the current flowing through the middle-stage circuit 12 and the second load transistor 32 becomes equal to the value of the current flowing through the lower-stage circuit 13. The voltage of the intermediate voltage supply line Vce1, which forms the node connecting between the upper-stage circuit 11 and the middle-stage circuit 12, is at 2(Vdd+Vss)/3 e.g., 2.2 volts, and the voltage of the intermediate voltage supply line Vce2, which forms the node connecting between the middle-stage circuit 12 and the lower-stage circuit 13, is at (Vdd+Vss)/3, e.g., 1.1 volts.

Depending on which circuit consumes the largest amount of power, the positions of the load transistors may be different from those shown in the figure. For example, if the power consumption of the upper-stage circuit 12 is the largest, then the load transistors (current sources) are connected in parallel with the middle-stage circuit 12 and lower-stage circuit 13, respectively.

In this way, the semiconductor integrated circuit of the present invention can be applied not only to a configuration where two stages of circuit blocks are connected in vertical series between the high voltage supply line and low voltage supply line, but also to a configuration where three or more (n) stages of circuit blocks are connected in vertical series between the high voltage supply line and low voltage supply line.

As detailed above, according to the semiconductor integrated circuit of the present invention, load means are connected in parallel with multiple stages of circuit blocks arranged in vertical series between the high voltage and low voltage supply lines, thereby making the value of value consumption approximately equal among the circuit blocks; this makes it possible to generate a stable intermediate voltage and prevent increases in power consumption and circuit area.

Many different embodiments of the present invention may be constructed without departing from the spirit and scope of the present invention, and it should be understood that the present invention is not limited to the specific embodiments described in this specification, except as defined in the appended claims.

What is claimed is:

1. A semiconductor integrated circuit comprising:

a plurality of circuits arranged in separate multiple stages of circuit blocks including at least an input circuit and an output circuit, the multiple stages of circuit blocks arranged vertically between a first power supply line and a second power supply line, the first power supply line having a voltage value greater than said second power supply line, and an intermediate power supply line arranged between each of said multiple stages of circuit blocks, said intermediate power supply line having a voltage value between the voltage values of the power supply lines directly above and below said intermediate power supply line; and a load unit connected in parallel with at least one of said circuits arranged in separate multiple stages of circuit blocks, wherein said at least one circuit consumes less power than a circuit in another one of said multiple stages of circuit blocks, such that a total power consumed by said load unit and said at least one circuit in parallel with said load unit is approximately equal to a power consumed by each of other ones of said multiple stages of circuit blocks.

2. A semiconductor integrated circuit as claimed in claim 1, wherein said load unit is provided in each of said circuit blocks except a circuit block having a largest current consumption amount.

3. A semiconductor integrated circuit as claimed in claim 1, wherein said load unit comprises at least one of a transistor and an inverter.

4. A semiconductor integrated circuit as claimed in claim 1, wherein each of said circuit blocks comprises a direct coupled field effect transistor logic circuit.

5. A semiconductor integrated circuit comprising:

two stages of circuit blocks, including an input circuit block and an output circuit block arranged between a first power supply line and a second power supply line, the first power supply line having a voltage value greater than said second power supply line, and an intermediate power supply line arranged between said circuit blocks, said intermediate power supply line having a voltage value between the voltage value of the first power supply line and the voltage value of the second supply line, wherein the circuit which is smaller in power consumption is provided with a load unit connected in parallel therewith so that a total power consumption of said input circuit block and a total power consumption of said second circuit block are approximately equal.

6. A semiconductor integrated circuit as claimed in claim 5, wherein said load unit comprises at least one of a transistor and an inverter.

7. A semiconductor integrated circuit as claimed in claim 5, wherein said input circuit block and said output circuit block each comprise a direct coupled field effect transistor logic circuit.

8. A semiconductor integrated circuit as claimed in claim 7, wherein said semiconductor integrated circuit is a fiber channel integrated circuit, said input circuit block includes a multiplexing circuit for multiplexing low-speed parallel data and outputting high-speed serial data, and said output circuit block includes a demultiplexing circuit for demultiplexing the high-speed serial data and outputting the low-speed parallel data.

9. A semiconductor integrated circuit as claimed in claim 8, wherein an input buffer circuit for amplifying parallel input data to be supplied to said multiplexing circuit is configured so as to cause a full swing between a first supply voltage on said first power supply line and a second supply voltage on said second power supply line in a circuit stage in front of a circuit stage where level shifting to a signal level suited to said multiplexing circuit is performed.

10. A semiconductor integrated circuit as claimed in claim 8, wherein said semiconductor integrated circuit further comprises a transmit clock generating circuit for supplying a first internal clock to said multiplexing circuit, and a receive clock generating circuit for supplying a second internal clock to said demultiplexing circuit.

11. A semiconductor integrated circuit as claimed in claim 10, wherein said semiconductor integrated circuit further comprises a loopback stage for shifting a level of an output signal of said multiplexing circuit, and for supplying said level-shifted signal to said receive clock generating circuit.

12. A semiconductor integrated circuit as claimed in claim 11, wherein said loopback stage outputs complementary signals by using a differential circuit.

* * * * *